US010090079B2

(12) United States Patent
Yoshida et al.

(10) Patent No.: US 10,090,079 B2
(45) Date of Patent: Oct. 2, 2018

(54) COVERED WIRE, COVERED WIRE WITH TERMINAL, WIRE HARNESS AND METHOD OF MANUFACTURING COVERED WIRE

(71) Applicants: Furukawa Electric Co., Ltd., Tokyo (JP); Furukawa Automotive Systems Inc., Shiga (JP)

(72) Inventors: Sho Yoshida, Tokyo (JP); Kengo Mitose, Tokyo (JP); Shigeki Sekiya, Tokyo (JP)

(73) Assignees: FURUKAWA ELECTRIC CO., LTD., Tokyo (JP); FURUKAWA AUTOMOTIVE SYSTEMS, INC., Shiga (JP)

( * ) Notice: Subject to any disclaimer, the term of this patent is extended or adjusted under 35 U.S.C. 154(b) by 0 days.

(21) Appl. No.: 15/493,869

(22) Filed: Apr. 21, 2017

(65) Prior Publication Data

US 2017/0229211 A1 Aug. 10, 2017

Related U.S. Application Data

(63) Continuation of application No. PCT/JP2015/081342, filed on Nov. 6, 2015.

(30) Foreign Application Priority Data

Nov. 10, 2014 (JP) ..... 2014-228105

(51) Int. Cl.
*H01B 7/32* (2006.01)
*H01B 13/02* (2006.01)
(Continued)

(52) U.S. Cl.
CPC ..... *H01B 7/0045* (2013.01); *H01B 7/32* (2013.01); *H01B 13/02* (2013.01); *H01B 13/22* (2013.01); *H01B 13/34* (2013.01); *H01R 25/003* (2013.01)

(58) Field of Classification Search
CPC ..... H01B 7/00; H01B 13/34; H01B 13/02; H01B 7/32; H01B 13/22; H01B 7/0045;
(Continued)

(56) References Cited

U.S. PATENT DOCUMENTS 1,896,043 A * 1/1933 Ruben ..... H01B 13/065 106/237
2,567,162 A * 9/1951 Sanders ..... H01B 7/292 156/89.18
(Continued)

FOREIGN PATENT DOCUMENTS

JP H11-154425 A 6/1999
JP 2004-134212 A 4/2004
JP 2011-222364 A 11/2011

OTHER PUBLICATIONS

English Translation of Written Opinion from Corresponding Application No. PCT/JP2015/081342; dated Jan. 26, 2016.
(Continued)

*Primary Examiner* — Michael F McAllister
(74) *Attorney, Agent, or Firm* — Pearne & Gordon LLP

(57) ABSTRACT

A covered wire includes a wire including a metal, a covering layer provided at a periphery of the wire, and inclusions including at least one of a metal and a metal oxide. The inclusions are provided between the wire and the covering layer or in the covering layer, and an average size of each of the inclusions is less than a thickness of the covering layer.

6 Claims, 4 Drawing Sheets

(51) Int. Cl.

| | |
|---|---|
| ***H01B 13/22*** | (2006.01) |
| ***H01B 13/34*** | (2006.01) |
| ***H01B 7/00*** | (2006.01) |
| ***H01R 25/00*** | (2006.01) |

(58) Field of Classification Search
CPC ..... H01R 25/00; H01R 25/003; C23C 28/02; C23C 2/06; C23C 2/38; C23C 28/00; B05D 3/10; B05D 7/20; B05D 7/24
USPC ..... 174/72 A
See application file for complete search history.

(56) References Cited

U.S. PATENT DOCUMENTS 5,091,609 A * 2/1992 Sawada ..... C23C 18/1216 174/110 A
5,149,917 A * 9/1992 Sawada ..... B60R 16/0215 174/110 R
9,508,461 B2 * 11/2016 Elie ..... H01B 7/0009
9,786,403 B2 * 10/2017 Yoshinaga ..... C22C 9/00
2008/0047733 A1 * 2/2008 Axakov ..... H05B 3/56 174/110 R
2012/0152590 A1 * 6/2012 Yin ..... H01B 3/006 174/118
2014/0238554 A1 * 8/2014 Yin ..... H01B 3/006 148/537
2016/0028294 A1 * 1/2016 Hirao ..... H02K 15/0414 219/117.1

OTHER PUBLICATIONS

International Preliminary Report on Patentability from Corresponding Application No. PCT/JP2015/081342; dated May 16, 2017.
International Search Report and Written Opinion from Corresponding Application No. PCT/JP2015/081342; dated Jan. 26, 2016.

* cited by examiner

COVERED WIRE, COVERED WIRE WITH TERMINAL, WIRE HARNESS AND METHOD OF MANUFACTURING COVERED WIRE

CROSS REFERENCE TO RELATED APPLICATIONS

This is a continuation application of International Patent Application No. PCT/JP2015/081342 filed Nov. 6, 2015, which claims the benefit of Japanese Patent Application No. 2014-228105, filed Nov. 10, 2014, the full contents of all of which are hereby incorporated by reference in their entirety.

BACKGROUND

Technical Field

The present disclosure relates to a covered wire including a covered conductor, a covered wire with terminal, a wire harness and a method of manufacturing a covered wire, and particularly relates to a covered wire, a covered wire with terminal, a wire harness and a method of manufacturing a covered wire in which detection of a defect such as a hole that is unintentionally produced in a covering layer in a manufacturing process is facilitated.

Background

In the related art, a so-called wire harness is used as an electric wiring structure for transportation vehicles such as automobiles, trains, and aircrafts, or an electric wiring structure for industrial robots. A wire harness is a member including covered wires each having a conductor made of copper or copper alloy, aluminum or aluminum alloy and fitted with terminals (connectors) made of copper or copper alloy (e.g., brass), aluminum or aluminum alloy. With recent rapid advancement in performances and functions of automobiles, various electrical devices and control devices installed in vehicles tend to increase in number, and electric wiring structures used for those devices also tend to increase in number. However, even if a defect such as a flaw, a crack, or a hole is produced in a covering layer unintentionally by some reason during the manufacturing process of a wire harness, an electric wire in which a defect has been produced could be directly assembled in a wire harness. In order to prevent such a situation, there is a need for a method with which a defect that is produced in a covering layer can be detected during a manufacturing process of a covered wire or a manufacturing process of a wire harness.

For example, by inspecting a covered wire immediately after a step of forming a covering layer over a conductor and detecting, by image analysis or the like, a defect formed in the covering layer, a covered wire in which a defect is produced can be removed as a reject product. However, if a defect is produced unintentionally in a subsequent step of manufacturing an electric wiring structure, which includes covered wires routed by bundling or the like, it is not possible to detect such a defect with the method mentioned above.

A covered wire of the related art used for an electric wiring structure of vehicles is described, for example, in Japanese Laid-Open Patent Publication No. 2004-134212, as an aluminum electric wire that is used for an automotive wire harness and having a characteristic equivalent to a copper wire.

However, the aforementioned Japanese Laid-Open Patent Publication No. 2004-134212 neither discloses nor suggests a method of defecting a defect that is produced in a covering layer.

Also, when manufacturing a covered wire, there is a method of detecting a defect in a covering layer with a flaw detector before a final winding-up step. However, with this method, it is not possible to detect a defect in the covering layer at the stage of manufacturing a wire harness using such covered wires.

The present disclosure is related to providing a covered wire, a covered wire with terminal, a wire harness and a method of manufacturing a covered wire, with which a defect that is produced in a covered wire manufacturing process as well as in a wire harness manufacturing process can be easily detected and further a defect in the wire harness can be easily detected.

For a covered wire that is applicable to a wire harness, the inventors have provided a plurality of inclusions between a conductor and a covering layer or in a covering layer, and carried out studies on an appropriate size and an appropriate density of the inclusions. As a result, the inventors have found that, in a case where a defect such as a flaw or a hole is produced in a covering layer in a process of manufacturing a covered wire or a wire harness, production of the defect can be easily detected utilizing the leakage of the inclusions from defect, and thus obtained the present invention.

SUMMARY

According to a first aspect of the present disclosure, a covered wire includes a wire comprising a metal, a covering layer provided at a periphery of the wire, and inclusions comprising at least one of a metal and a metal oxide, the inclusions being provided between the wire and the covering layer or in the covering layer, an average size of each of the inclusions being less than a thickness of the covering layer.

According to a second aspect of the present disclosure, a covered wire with terminal includes a covered wire and a terminal fitted to an end portion of the covered wire, the covered wire including a wire comprising metal, a covering layer provided on a periphery of the wire, and inclusions comprising at least one of a metal and a metal oxide, the inclusions being disposed between the wire and the covering layer or in the covering layer, an average size of each of the inclusions being less than a thickness of the covering layer.

According to a third aspect of the present disclosure, a wire harness includes a covered wire with terminal combined with another wire, the covered wire with terminal includes a covered wire and a terminal fitted to an end portion of the covered wire, the covered wire including a wire comprising metal, a covering layer provided on a periphery of the wire, and inclusions comprising at least one of a metal and a metal oxide, the inclusions being disposed between the wire and the covering layer or in the covering layer, an average size of each of the inclusions being less than a thickness of the covering layer.

According to a fourth aspect of the present disclosure, a method of manufacturing a covered wire, the method includes forming a wire, the wire being one of an individual wire and a stranded wire, the stranded wire comprising a plurality of individual wires stranded together, attaching inclusions to the wire, the inclusions comprising at least one of a metal and a metal oxide, and forming a covering layer over the wire.

According to the present disclosure, by providing a plurality of inclusions between the conductor and the covering layer or in the covering layer, and in particular, by determining an average size of each of the inclusions and/or number density of the inclusions to be within the aforementioned ranges, in a case where a defect such as a flaw, a crack, or a hole is produced in the covering layer in a manufacturing process, the inclusions leak out from the covered wire to an outside through such a defect. By detecting or sensing the inclusions which have leaked out, it is possible to easily detect that a defect is produced in the covered wire by visual inspection or a sensor, not only in the covered wire manufacturing process but also in the wire harness manufacturing process. Further, it may result in an improvement in a percentage of good products of a covered wire and a wire harness, and harnesses having a good insulation performance can be supplied steadily.

DESCRIPTION OF THE EMBODIMENTS

Further features of the present disclosure will become apparent from the following detailed description of exemplary embodiments with reference to the accompanying drawings.

Figure 1A:
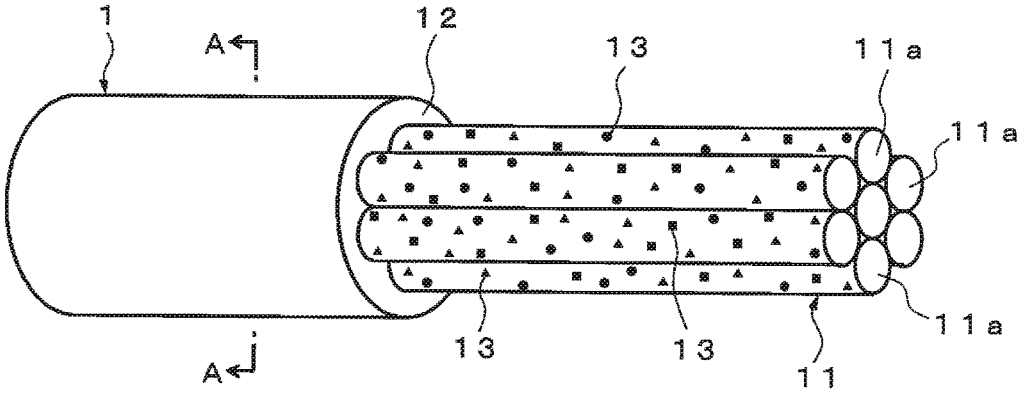
FIG. 1A is a perspective view schematically showing a configuration of a covered wire according to an embodiment of the present disclosure.

As shown in FIG. 1A, a covered wire 1 of the present embodiment has a wire 11 composed of a metal, a covering layer 12 provided at a periphery of the wire, and inclusions 13 provided between the wire 11 and the covering layer 12 or in the covering layer 12 and composed of at least one of a metal and a metal oxide.

The wire 11 is a stranded wire including a plurality of individual wires 11*a* stranded together, and made of, for example, aluminum, an aluminum alloy, copper or a copper alloy. In the present embodiment, the wire 11 is a stranded wire, but it is not limited thereto, and it may be a solid wire.

The covering layer 12 is, for example, an insulating layer that is a layer of polyvinyl chloride (PVC), crosslinked polyethylene, etc., or a multilayered structure including one of those layers, but it is not particularly limited thereto, as long as it is capable of insulating the wire 11 from outside. The thickness of the covering layer 12 is determined by observing a cross-section with a microscope, measuring the maximum covering thickness and the minimum covering thickness, performing similar measurements for three cross sections, and taking an average value of the obtained measurement values as a thickness of the covering layer 12.

Figure 1B:
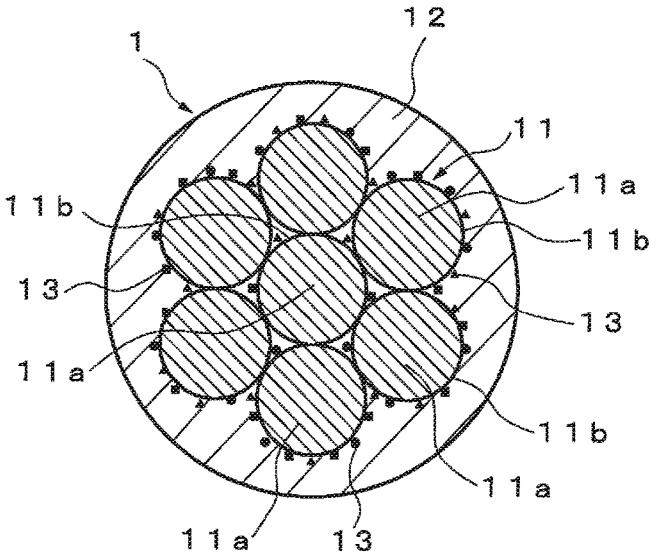
FIG. 1B is a cross sectional view taken along line A-A of FIG. 1A.
Figure 2:
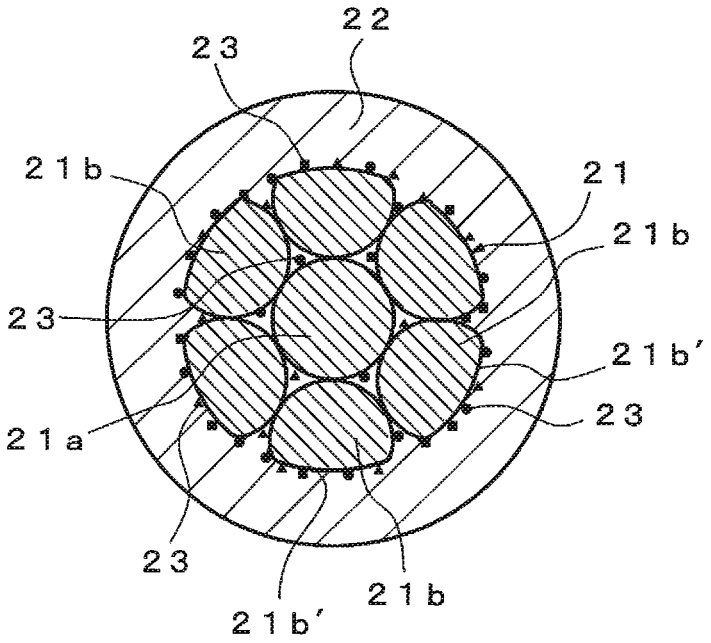
FIG. 2 is a cross sectional view showing a variant embodiment of the covered wire of FIG. 1B.

As shown in FIG. 1B, the inclusions 13 are provided at an interface between the individual wire 11*a* and the covering layer 12 (an outer surface 11*b* of the individual wire 11*a*), or in the vicinity thereof, and also provided in the covering layer 12. In FIG. 1A, FIG. 1B and FIG. 2, the inclusions 13 are represented by pictorial symbols "○" (circle), "Δ" (triangle) and "□" (square) for the sake of convenience, but shapes and components thereof may be the same or different with respect to one another. The shape of inclusions 13 may be of various shapes such as a spherical shape, an ellipsoid, a cuboid shape, a parallelepiped shape, and a whisker shape.

Hereinafter, size, density and components of the inclusions 13 will be described in detail.

<Size, Density and Components of the Inclusions>

In order to detect a defect in the covered wire 1 utilizing the leakage of the inclusions 13, it is preferable that inclusions are of a size with which they are easy to fall from a defect, i.e., have a small size, so that the inclusions 13 leak out as soon as the defect is produced in the covering layer 12, and on the other hand, inclusions of a certain size are required so that the inclusions can be easily viewed and detected when they have leaked, and an average size of each of the inclusions 13 needs to be less than the thickness of the covering layer 12. For example, in a case where each of the inclusions 13 has a generally elliptical shape in a plan view, an average size of the inclusion 13 can be determined based on an average value of a major diameter and a minor diameter of a particle which is an inclusion:

$$(\text{average size})=\{(\text{major diameter})+(\text{minor diameter})\}/2.$$

An average size of the inclusion 13 may also be determined based on an average value of a size in a longitudinal direction and a size in a widthwise direction, which is orthogonal to the longitudinal direction. Measurement of size is carried out using a magnifying glass. For a shape other than a substantially elliptical shape, such as a crescent shape, diagonals of a rectangle containing said shape are drawn, and an average size is calculated by taking the diagonal having the longest length as a major diameter and the diagonal having the shortest length as a minor diameter. This is because in a case where the average size of the inclusion 13 is greater than the thickness of the covering layer, the covering may break, and an insulation property may be lost. Specifically, it is preferable that the average size of each of the inclusion 13 in a direction of thickness of the covering layer 12 is less than or equal to half of the thickness of the covering layer 12 in a state where the inclusions 13 are contained in the covering layer 12. Thereby, the possibility of losing an insulation property is suppressed, and the inclusions are capable of leaking out from a defect and detection of the inclusions is facilitated. For ease of visual inspection, a lower limit of the average size of the inclusion 13 is preferably around 1 μm, and the broadest portion of the inclusion 13, e.g., a maximum value of a projected area of the inclusion 13, is preferably greater than or equal to 100 $\mu m^2$. Thereby, detection of the inclusions 13 that have leaked out from a defect by visual inspection or with a sensor is facilitated.

The number density of the inclusions 13 is preferably one particle/$mm^3$ to 3000 particles/$mm^3$. In a case where the inclusions 13 are provided in the above-mentioned range of number density, detection of the inclusions 13 that have leaked out from the defect is facilitated. In a case where the number density of the inclusions 13 exceeds 3000 particles/$mm^3$, distortion of the shape of the covered wire 1 or a thickness deviation of the covering layer 12 is likely to occur, and in a case where it is less than one particle/$mm^3$, an amount of inclusions 13 leaking out from a defect becomes less, and it becomes difficult to detect a defect.

The inclusions 13 are composed primarily of a metal having a higher reflectivity in comparison to resins or the like, and, for example, those having an average reflectivity of greater than or equal to 70% for visible light are preferable. With the average reflectivity of greater than or equal to 70% for visible light, the reflectivity is higher than that of the floor surface of the workplace, and thus detection of the inclusions can be facilitated. Also, it is preferable that the metal content of a single inclusion 13 is greater than or equal to 50% by volume. The inclusion 13 contains a metal oxide or the like at a surface and/or internally, and in a case where the metal content of a pure metal component to the entire inclusion is greater than or equal to 50% by volume, metallic luster facilitates detection of the inclusion 13. Particularly, in a case where the metal is Cu or Fe and the metal content of the inclusions 13 is less than 50% by volume, an average reflectivity for visible light may greatly decrease. In a case where particular attention is required for a decrease in electric conductivity and a wire surface, it is preferable that the inclusions 13 are comprised of or consisting of a metal or an alloy material containing components that are the same or equivalent to those of the wire 11.

<Method of Manufacturing Inclusions>

The inclusions 13 per se can be prepared by machining or grinding a metal ingot. Also, when using the inclusions 13 of components equivalent to those of the individual wire 11*a*, a method of manufacturing inclusions 13 may include machining from an individual wire 11*a* during the manufacturing process of a covered wire 1, or detaching from an outer surface 11*b* of the individual wire 11*a* as a result of the individual wires 11*a* coming into contact with each other. Specific embodiments of the method of manufacturing the inclusions include, for example, the following methods.

(i) Sinter alumina ($Al_2O_3$), grind the obtained sintered alumina with a ball mill, and thereafter classify the ground alumina (perform particle sizing) using a sieving machine to obtain inclusions of a predetermined size.

(ii) Cut (peel) the surface of a metal of a desired composition, grind the obtained peeled product with a ball mill, and thereafter classify the ground alumina (perform particle sizing) using a sieving machine to obtain inclusions of a predetermined size.

<Method of Providing Inclusions>

By providing the inclusions 13 onto the outer surface 11*b* of the individual wire 11*a* before applying the covering layer 12 to the wire 11, the inclusions 13 can be provided between the wire 11 and the covering layer 12. For example, a method of attaching the inclusions 13 after having applied a tacky fluid to an outer surface 11*b* of the individual wire 11*a* that has been subjected to wire drawing, or a method of spraying the inclusions 13 from top, bottom, right and left of the wire 11 just before applying a resin for forming a covering layer 12 to the wire 11 may be used.

For example, just before the covering layer forming step, application may be performed by regulating the rate of flow of gas containing the inclusions in-line. A viscous liquid may be coated on an outer surface of the wire for the purpose of improving a density of the inclusions. Also, the inclusions may be applied together with air to the outer peripheral surface of the wire from four directions, i.e., top, bottom, right and left, for the purpose of uniformly providing on an outer periphery of the wire.

In a case where the wire is a stranded wire, the inclusions may be provided in a twisting step. For example, the stranded wire may be provided with inclusions by applying, coating, applying with air, or manufacturing the inclusions by causing the individual wires to rub against each other.

With the methods of providing the inclusions as described above, in principle, all of the inclusions 13 are in contact with the outer surface 11*b* of the individual wire 11*a*, and comes to a state where they are provided at an interface between the individual wire 11*a* and the covering layer 12. However, exceptionally, there is a case in which viscosity between the inclusions 13 and the individual wire 11*a* inevitably weakens in the application step, and the inclusions 13 loosely exist in the resin before hardening, and thereafter the resin is hardened and the covering layer 12 is formed. In this case, although the inclusions 13 are not in contact with the outer surface 11*b* of the individual wire 11*a* and exist within the covering layer 12, a defect can be detected by such inclusions 13.

<Improvement of Reflectivity of Inclusions>

The inclusions 13 are detected by whether reflected light produced by incident light reflecting on a surface of the inclusion exists or not. Therefore, considering the ease of viewing or detection, it is more preferable that the inclusions 13 are composed of a metal material. The reflectivity of the metallic material varies due to surface irregularity. However, microscopically, diffuse reflection light is produced on a surface of the metal material together with strong specular reflection light (regular reflection light), and thus the inclusions 13 can be detected by metallic luster more easily and positively. Incident light may be sunlight, and may be infrared light emitted from an infrared irradiation apparatus or the like, as long as it is a detectable electromagnetic wave. In the present embodiment, the material of inclusion 13 is preferably one or more of an aluminum alloy (6xxx series aluminum alloy), an aluminum oxide (alumina), a magnesium alloy and a magnesium oxide.

<Method of Measuring Number Density of Inclusion>

The number density of the inclusions 13 as described above is the number of inclusions 13 per unit volume of an electric wire. When there are N inclusions for an electric wire having a wire outer diameter of R and a length of L, a number density D can be expressed by the following computational expression (1):

$$D=4N/\pi R^2 \cdot L \quad (1)$$

The number density of inclusions is measured at five positions, and an average thereof is used as a number density D. Five pieces of electric wire are prepared by cutting out a length of 5 cm at each of the positions situated at an interval of 1 m. Then an obtained electric wire is disassembled, and the inclusions 13 at an inside are taken out onto a flat platform and counted by visual inspection. Alternatively, when there are a large number of inclusions 13, the number may be counted by image analysis. For image analysis, a software for binarizing an image, such as "Image J" (developed by Wayne Rasband) is available. It is to be noted that, in a case where there are remaining inclusions 13 at the wire and the covering layer, these are also counted. Thereafter, the number densities at the respective positions are calculated from the aforementioned computation expression (1), and the number density D is obtained by calculating an average of the number densities.

<Detection Methods of Inclusions Leaked Out from a Defect of the Electric Wire>

After the covering layer forming process, at any step such as a covered wire winding process and the wire harness manufacturing process to be described below, if an unintended defect is produced, the inclusions are detectable. Here, as a method of efficiently detecting the inclusions that have leaked out, for example, there are methods as follows:

(i) Since an operation of assembling a covered wire into a wire harness is generally performed on a single piece of board, a black board is used, and the inclusions fallen on the black board are viewed. Further, in a case where the aforementioned assembling operation is performed on a floor surface, a black-color coated floor surface is used, and the inclusions fallen on the floor surface is viewed.

(ii) Using a black returnable box (container) for carrying the assembled wire harness, the inclusions fallen in a returnable box are viewed with the wire harness being placed in the returnable box. Since production of an unintended hole may be produced before assembling the wire harness due to an unexpected shock, the inclusions can be efficiently detected by performing detection in the wire harness assembling step. Also, since the inclusions that have fallen off are retained in the returnable box, it becomes easier to view the inclusions even if a very small amount of the inclusions 13 that have fallen down, and production of a defect can be detected at an early stage.

<Other Configuration of the Wire>

The wire may be a stranded wire composed of a plurality of individual wires as shown in FIGS. 1A and 1B or may be a compressed stranded wire as shown in FIG. 2. Specifically, the wire 21 may be a compressed stranded wire in which the individual wire 21*a* located at a central part shows almost no plastic deformation, but individual wires 21*b* located at an outer periphery are plastically deformed. Like the case of the stranded wire, the inclusions 23 are provided between the wire 21 and the covering layer 22, specifically, provided at an interface between the outer surface 21*b*' of the individual wire 21*b* and the covering layer 22 or the vicinity thereof, and also provided within the covering layer 22.

In any of the cases in which the wire is a stranded wire, a compressed stranded wire, or a solid wire, the defect that is produced unintentionally can be detected by the inclusions. Particularly, the wire configured as a stranded wire provides improvement in elongation, flexing property and impact resistance, and the wire configured as a compressed stranded wire provides improvement in working efficiency in the stranded wire manufacturing process, such as a decrease in stranding defect and a decrease in untwisting after stripping.

<Configuration of Covered Wire with Terminal>

Figure 3:
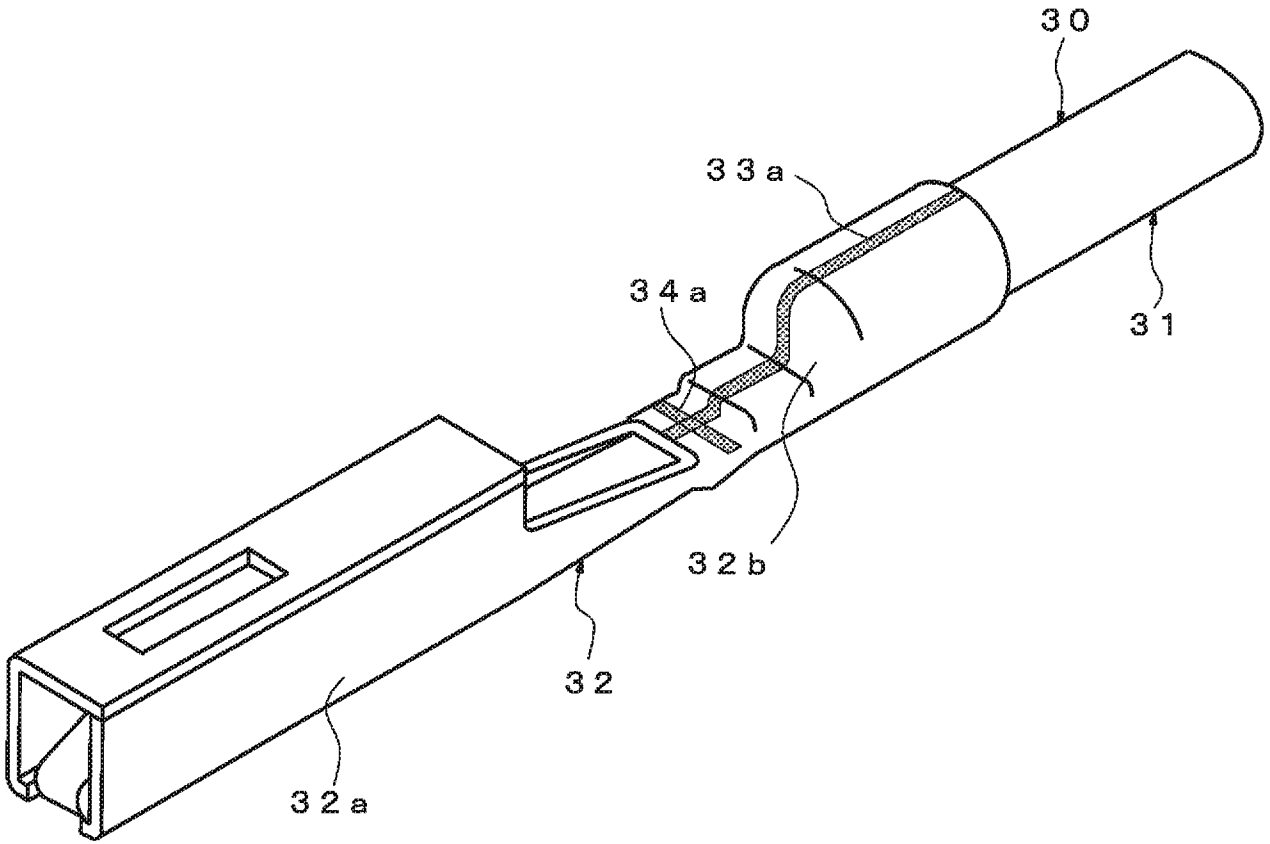
FIG. 3 is a perspective view showing a covered wire with terminal including the covered wire of FIGS. 1A and 1B and a terminal.

Using the covered wire 1 shown in FIGS. 1A and 1B, a covered wire with terminal that includes a terminal attached to an end portion of the covered wire 1 can be obtained. For example, as shown in FIG. 3, a covered wire with terminal 30 includes a covered wire 31 and a terminal 32 attached to an end portion of said covered wire. The covered wire 31 has a configuration similar to that of the covered wire shown in FIGS. 1A and 1B, and thus the description thereof is omitted.

The terminal 32 is, for example, a female terminal, and has a connecting portion 32*a* having a box shape and allowing insertion of, for example, an insertion tab of a male terminal, and a barrel portion 32*b* having a one end closed tubular shape. By crimping the barrel portion 32 with an end portion of the covered wire 31 from which the covering layer is removed being inserted into the barrel portion 32*b*, the wire and the covering layer crimp with the barrel portion 32*b*, whereby the terminal is mounted to the end portion of the covered wire 31. The barrel portion 32*b* is formed into a tubular shape with one end closed, for example, by welding. Specifically, by three-dimensionally pressing a planar spread-out metal substrate, a tubular body having a generally C-shaped cross section is formed, and an open portion (butted portion) of the tubular body is laser welded. Since laser welding is performed in a longitudinal direction of the tubular body, a welded portion 33*a* (weld-bead) is formed in generally the same direction as the longitudinal direction of the tubular body by butt welding. Also, subsequently, a welded portion 34*b* is formed in a direction perpendicular to the longitudinal direction of the tubular body to thereby seal a leading edge side of the barrel portion 32*b* and to make the barrel portion 32*b* into a one-end closed tubular shape. By this sealing, moisture is prevented from entering into the barrel portion 32*b* from the connecting portion 32*a* side. It is to be noted that as for the covered wire with terminal 30 shown in FIG. 3, a terminal of a closed barrel type is attached to the covered wire 31 but, it is not limited thereto, and a terminal of an open barrel type may be attached to the covered wire 31.

<Configuration of Wire Harness>

Figure 4:
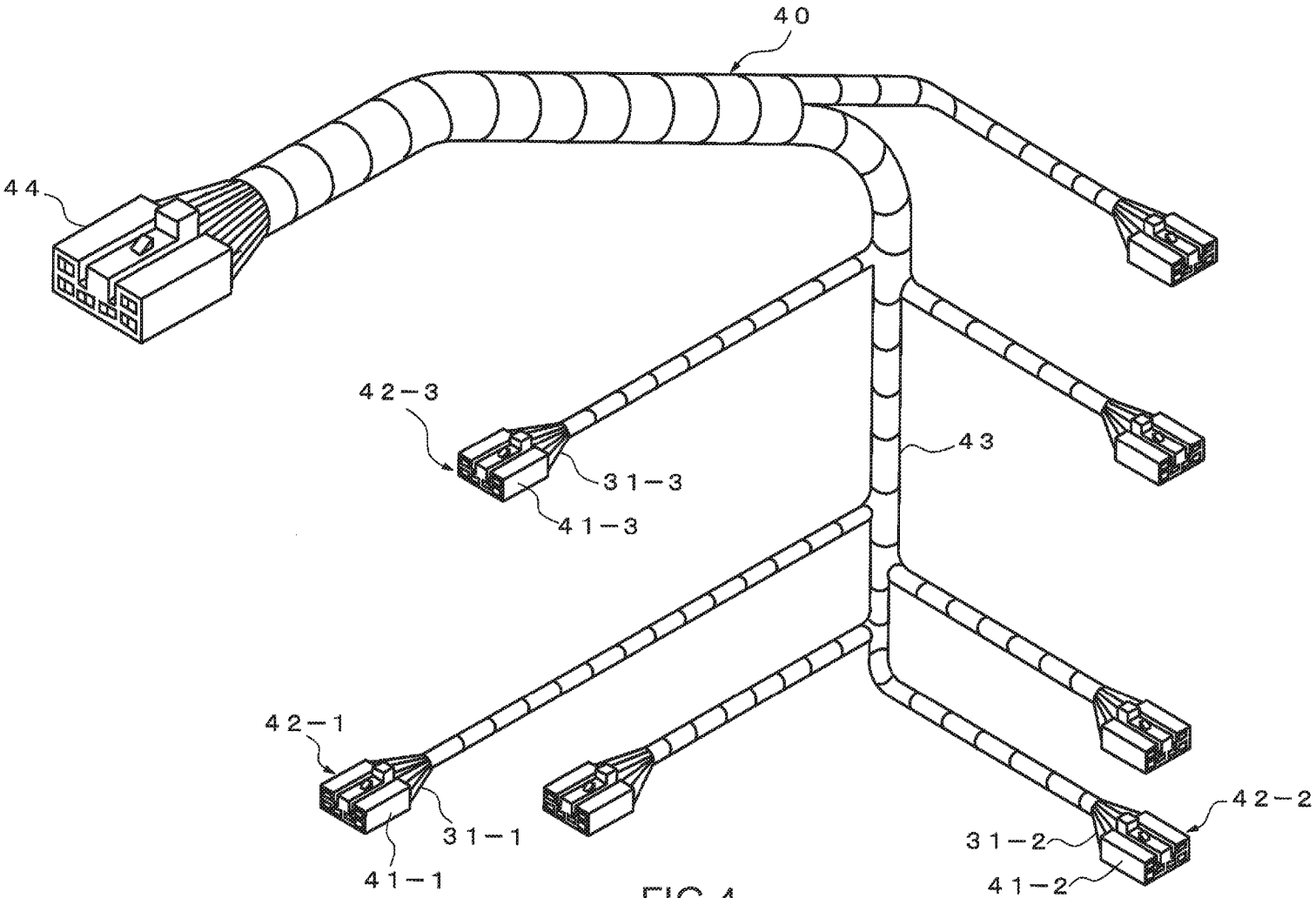
FIG. 4 is a perspective view showing a wire harness including the covered wire with terminal of FIG. 3.

As shown in FIG. 4, a wire harness 40 includes a connecting structure 42-1 having a covered wire with terminal 31-1 and a connector 41-1 attached to an end portion of the covered wire with terminal 31-1. The wire harness 40 further includes other connecting structures 42-2, 42-3, . . . , having other covered wires with terminals 31-2, 31-3, . . . and other connectors 41-2, 41-3, . . . attached to end portions of the other covered wires with terminals 31-2, 31-3, . . . , respectively, and made into a wire harness by bundling the connecting structures 42-1, 42-2, 42-3, . . . with a wrapping tape 43 in combination with components that are not shown, and further providing a collective connector 44 or the like at an end portion thereof. In this manner, by applying the covered wire with terminal of the present embodiment to a wire harness, detection of production of a defect in a manufacturing process of a wire harness is facilitated, and this makes it possible to lead to an improvement in the percentage of good products for a wire harness.

EXAMPLES

The present disclosure will be described in detail based on the following examples. It is to be noted that the present disclosure is not limited to examples shown below.

Example 1

Using a Properzi-type continuous casting rolling mill, molten metal containing Mg, Si, Fe, Mn, Cr, Zr and Ni by a predetermined amount was continuously cast with a water-cooled mold and rolled into an aluminum alloy bar of ϕ9.5 mm. Then, a first wire drawing was performed out until ϕ2.6 mm, and a predetermined heat treatment was performed for the main purpose of softening. Further, after having performed a second wire drawing until a wire size of ϕ0.3 mm, the obtained seven individual wires were twisted into a stranded wire. Thereafter, a solution heat treatment and an aging heat treatment were sequentially applied, thus producing an aluminum alloy stranded wire (conductor). After having applied an oil to the obtained stranded wire, inclusions of the same composition as the wire and having an ellipsoidal shape of an average size of 0.01 mm were blown, and thereafter covering of PVC resin was performed with an extruder to provide a covering layer of a thickness of 0.2 mm, thus obtaining an aluminum alloy covered wire containing inclusions. During this, the blowing speed was adjusted to blow the inclusions such that an average number density is 490 particles/$mm^3$.

Example 2

A tough pitch copper bar of ϕ9.5 mm was manufactured by SCR process with tough pitch copper. After wire drawing the tough pitch copper bar until a wire size of ϕ0.3 mm, the obtained seven individual wires were twisted into a stranded wire. Thereafter, a softening heat treatment was applied to produce a tough pitch copper stranded wire. After having applied an oil to the obtained stranded wire, inclusions composed primarily of magnesium and having an ellipsoidal or whisker shape of an average size of 0.07 mm were blown such that the number density was 25 particles/mm$^3$, and thereafter covering of PVC resin was performed with an extruder to provide a covering layer of a thickness of 0.2 mm, thus obtaining a copper alloy covered wire containing inclusions.

Example 3

Using a Properzi-type continuous casting rolling mill, molten metal containing Mg, Si and Fe by a predetermined amount was continuously cast with a water-cooled mold and rolled into an aluminum alloy bar of ϕ9.5 mm. Then, a first wire drawing was performed out until ϕ2.6 mm, and a predetermined heat treatment was performed for the main purpose of softening. Further, after having performed a second wire drawing until a wire size of ϕ0.3 mm, the obtained seven individual wires were twisted into a stranded wire. Thereafter, a solution heat treatment and an aging heat treatment were sequentially applied, thus producing an aluminum alloy stranded wire. After having applied an oil to the obtained stranded wire, inclusions of the same composition as the wire and having a spherical shape of an average size of 0.01 mm were blown, and thereafter covering of PVC resin was performed with an extruder to provide a covering layer of a thickness of 0.2 mm, thus obtaining an aluminum alloy covered wire containing inclusions. During this, the blowing speed was adjusted such that inclusions were blown such that the average number density is 2860 particles/mm$^3$.

Comparative Example 1

Using a Properzi-type continuous casting rolling mill, molten metal containing Mg, Si, Fe, Mn, Cr, Zr and Ni by a predetermined amount was continuously cast with a water-cooled mold and rolled into an aluminum alloy bar of ϕ9.5 mm. Then, a first wire drawing was performed out until ϕ2.6 mm, and a predetermined heat treatment was performed for the main purpose of softening. Further, after having performed a second wire drawing until a wire size of ϕ0.3 mm, the obtained seven individual wires were twisted into a stranded wire. Thereafter, a solution heat treatment and an aging heat treatment were sequentially applied, thus producing an aluminum alloy stranded wire, and thereafter covering of PVC resin was performed with an extruder to provide a covering layer of a thickness of 0.2 mm, thus obtaining an aluminum alloy covered wire that does not contain inclusions.

Comparative Example 2

A tough pitch copper bar of ϕ9.5 mm was manufactured by SCR with tough pitch copper. After performing wire drawing until a wire size of ϕ0.3 mm, the obtained seven individual wires were twisted into a stranded wire. Thereafter, a softening heat treatment was applied to produce a tough pitch copper stranded wire, and thereafter covering of PVC resin was performed with an extruder to provide a covering layer of a thickness of 0.2 mm, thus obtaining a copper alloy covered wire that does not contain inclusions.

Comparative Example 3

Onto a conductor of the same components as Example 1, inclusions of the same composition as the conductor and having an ellipsoidal shape of an average size of 1.1 mm were blown such that an average number density is 440 particles/mm$^3$, and thereafter covering of PVC resin was performed with an extruder to provide a covering layer of a thickness of 0.2 mm, thus obtaining an aluminum alloy covered wire containing inclusions.

Then, each of the obtained covered wires was evaluated by a method shown below.

(Detection of Inclusions)

A hole of 3 mm in length and 0.5 mm in width and penetrating through the covering was formed in the covering layer of the covered wire to simulate a hole which may be produced due to an unintended impact during working. Thereafter, on a black sheet, a movement simulating installation of a wire harness was applied to the covered wire, and detection of the inclusions was performed. A case where inclusions leaked out from a hole of the covered wire were detected is indicated as "GOOD", and a case where the inclusions were not detected is indicated as "BAD".

(Evaluation of Uniformity of Covering Layer Thickness)

Uniformity of a covering layer thickness is measured by a laser outer diameter measuring apparatus, and evaluated from the measured value.

Results of evaluation by the aforementioned method is shown in Table 1.

TABLE 1

| | Component of Wire (wt %) | | | | | | | | | Inevitable | Thickness of Covering |
|---|---|---|---|---|---|---|---|---|---|---|---|
| | Al | Cu | Mg | Si | Fe | Mn | Cr | Zr | Ni | Impurities | (mm) |
| EXAMPLE 1 | 98. 5 | — | 0.4 | 0.6 | 0.2 | 0.05 | 0.05 | 0.05 | 0.05 | Balance | 0.2 |
| EXAMPLE 2 | — | 99.9 | — | — | — | — | — | — | — | Balance | 0.2 |
| EXAMPLE 3 | 97.4 | — | 0.4 | 0.7 | 1.4 | — | — | — | — | Balance | 0.2 |
| COMPARATIVE EXAMPLE 1 | 98.5 | — | 0.4 | 0.6 | 0.2 | 0.05 | 0.05 | 0.05 | 0.05 | Balance | 0.2 |
| COMPARATIVE EXAMPLE 2 | — | 99.9 | — | — | — | — | — | — | — | Balance | 0.2 |
| COMPARATIVE EXAMPLE 3 | 98.5 | — | 0.4 | 0.6 | 0.2 | 0.05 | 0.05 | 0 05 | 0.05 | Balance | 0.2 |

TABLE 1-continued

| | Inclusion | | | | Detection of | Uniformity of Thickness |
|---|---|---|---|---|---|---|
| | Material | Shape | Ave Length (mm) | Ave. Num. Density (Inclusions/ $mm^3$) | Inclusions in Simulatition of Assembling of Wire Harness | of Covering Layer Constituting Covered Wire |
| EXAMPLE 1 | Same as Wire | Ellipsoid | 0.01 | 490 | GOOD | GOOD |
| EXAMPLE 2 | Mg | Ellipsoid and Whisker | 0.07 | 25 | GOOD | GOOD |
| EXAMPLE 3 | Same as Wire | Sphere | 0.01 | 2860 | GOOD | GOOD |
| EXAMPLE 1 COMPARATIVE | | No Inclusion | | | BAD | GOOD |
| COMPARATIVE EXAMPLE 2 | | No Inclusion | | | BAD | GOOD |
| COMPARATIVE EXAMPLE 3 | Same as Wire | Ellipsoid | ***1.1*** | 440 | GOOD | BAD (Defective due to Non-uniformity of Covering Layer Thickness) |

N.B. NUMERICAL VALUES IN BOLD ITALIC IN THE TABLE ARE OUT OF APPROPRIATE RANGE OF THE EXAMPLE

As shown in Table 1, in Examples 1 to 3, it was possible to detect a large number of inclusions, which have leaked out of the hole in the covered wire, on a black sheet.

Whereas in Comparative Examples 1 and 2, inclusions, which have leaked out of the hole in the covered wire, were not detected. In Comparative Example 3, an average size of each of the inclusions is beyond the scope of the present disclosure, and thus, the covered layer thickness after the resin covering became non-uniform, and a covering layer defect was produced.

According to the invention, it becomes easier to detect a defect such as a flaw, a crack, or a hole that is produced in the covering layer in a manufacturing process, and it is possible to suppress a decrease in an electric wire characteristic in an electric wire usage environment and occurrence of electric leakage, and to provide a covered wire that is safer than those of the related art. Accordingly, it is useful for a harness mounted on a vehicle and a wiring body of an industrial robot, and particularly useful for an automotive wire harness.

What is claimed is:

1. A covered wire comprising:

a wire comprising a metal;

a covering layer provided at a periphery of the wire; and inclusions comprising at least one of a metal and a metal oxide, the inclusions being provided between the wire and the covering layer or in the covering layer, an average size of each of the inclusions being less than a thickness of the covering layer, wherein the inclusions have an average reflectivity of greater than or equal to 70% for visible light.

2. The covered wire according to claim 1, wherein the average size of each of the inclusions in a thickness direction of the covering layer is less than or equal to ½of the thickness of the covering layer.

3. The covered wire according to claim 1, wherein a number density of the inclusions is 1 particle/$mm^3$ to 3000 particles/$mm^3$.

4. The covered wire according to claim 1, wherein the inclusions comprises a metal material that is the same as that of the wire.

5. The covered wire according to claim 1, wherein the wire is a stranded wire comprising a plurality of individual wires stranded together.

6. The covered wire according to claim 1, wherein the wire is a compressed stranded wire.

* * * * *